US008534370B1

(12) United States Patent
Al Azemi

(10) Patent No.: US 8,534,370 B1
(45) Date of Patent: Sep. 17, 2013

(54) ROOF MOUNTED REMOTELY CONTROLLED FIRE FIGHTING TOWER

(71) Applicant: Wasmeyyah M. A. S. Al Azemi, Mubarak Al-Kabeer (KW)

(72) Inventor: Wasmeyyah M. A. S. Al Azemi, Mubarak Al-Kabeer (KW)

( * ) Notice: Subject to any disclaimer, the term of this patent is extended or adjusted under 35 U.S.C. 154(b) by 0 days.

(21) Appl. No.: 13/761,086

(22) Filed: Feb. 6, 2013

Related U.S. Application Data

(63) Continuation of application No. 13/752,318, filed on Jan. 28, 2013.

(51) Int. Cl.
*A62C 35/00* (2006.01)

(52) U.S. Cl.
USPC ..... 169/46; 169/54; 169/15; 169/16; 169/24; 169/25; 239/281

(58) Field of Classification Search
USPC ..... 169/13, 14, 54, 56, 60, 61, 16, 70, 169/68; 239/208, 210, 168, 169, 166, 751
See application file for complete search history.

(56) References Cited

U.S. PATENT DOCUMENTS

| | | | | |
|---|---|---|---|---|
| 2,003,778 | A * | 6/1935 | Willis | 118/314 |
| 2,564,489 | A * | 8/1951 | Malin | 239/280 |
| 2,590,400 | A * | 3/1952 | Gollnick | 239/166 |
| 2,628,128 | A * | 2/1953 | Rhodeen | 239/168 |
| 3,055,594 | A * | 9/1962 | Nansel | 239/161 |
| 3,206,126 | A | 9/1965 | Thompson | |
| 3,817,397 | A | 6/1974 | Wellman | |
| 4,836,290 | A | 6/1989 | Le Lande, Jr. | |
| 5,692,571 | A | 12/1997 | Jackson | |
| 5,732,511 | A | 3/1998 | Scott | |
| 6,929,072 | B2 | 8/2005 | Brown | |
| 2011/0250043 | A1 | 10/2011 | Korchagin et al. | |

* cited by examiner

*Primary Examiner* — Len Tran
*Assistant Examiner* — Viet Le
(74) *Attorney, Agent, or Firm* — Richard C. Litman

(57) ABSTRACT

The roof-mounted remotely controlled firefighting tower is disposed on the top of the roof of a building and is controlled by a wireless, remote control device. Atop the tower there is a receiver that receives command signals from the remote control device. The firefighting apparatus includes a control set that has electrical and electronic circuits inside and is in operable communication with a motor and gear train engaging a telescoping mast to raise and lower the mast according to wirelessly transmitted commands from a user. A high pressure pump extracts water and foam from a tank and sends it to a distribution vessel on top of the mast. An inverted sprinkler dish distributes the foam and water under pressure to top and sides of the building via the connected sprinklers and water booms.

4 Claims, 4 Drawing Sheets

ROOF MOUNTED REMOTELY CONTROLLED FIRE FIGHTING TOWER

CROSS-REFERENCE TO RELATED APPLICATIONS

This is a continuation of my prior application Ser. No. 13/752,318, filed Jan. 28, 2013 now pending.

BACKGROUND OF THE INVENTION

1. Field of the Invention

The present invention relates to fire extinguishing devices, and more particularly to a roof-mounted remotely controlled firefighting tower that prevents the spread of a building fire by directing water and foam to the building from the exterior roof area using a remote control device.

2. Description of the Related Art

Several stationary devices have been developed for extinguishing building fires, such as fixed, indoor sprinkler systems. Such devices, while they fulfill their respective particular objectives and requirements, still lack flexibility of application to selectively target water on a burning building from the outside of the building.

Thus, a roof-mounted remotely controlled firefighting tower solving the aforementioned problems is desired.

SUMMARY OF THE INVENTION

The roof-mounted remotely controlled firefighting tower is disposed on the top of the roof of a building and is controlled by a wireless, remote control device. Atop the tower there is a receiver that receives command signals from the remote control device. The firefighting apparatus includes a control set that has electrical and electronic circuits inside and is in operable communication with a motor and gear train engaging a rack gear on a telescoping section of a mast to raise and lower the mast according to wirelessly transmitted commands from a user. A high pressure pump extracts water and foam from a tank and sends it to a distribution vessel on top of the mast. A distribution system distributes the foam and water under pressure to the top and the sides of the building via connected sprinklers, nozzles, and water booms.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
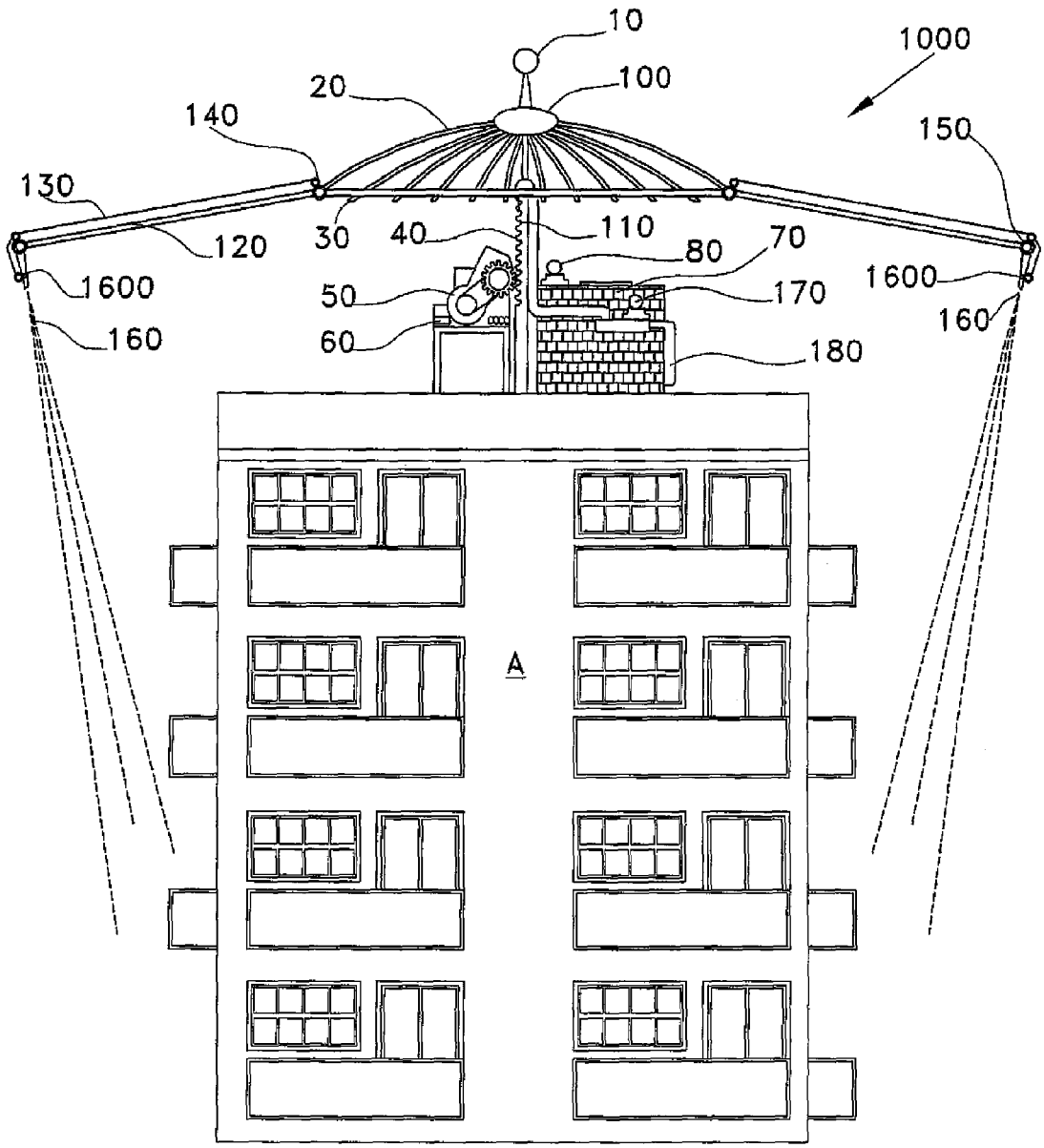
FIG. 1 is an environmental front view of a roof-mounted remotely controlled firefighting tower according to the present invention.
Figure 2:
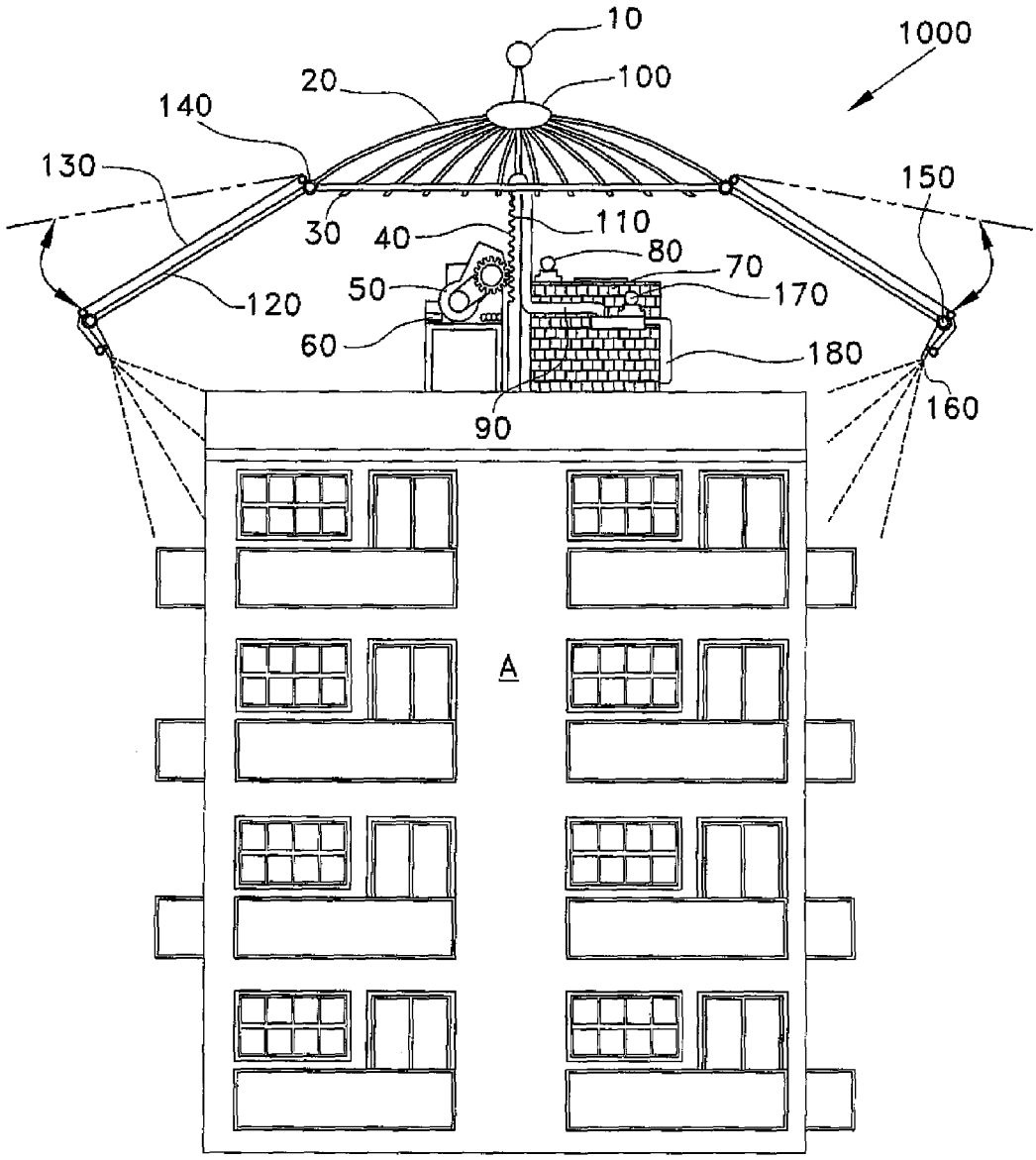
FIG. 2 is an environmental front view of the roof-mounted remotely controlled firefighting tower of FIG. 1, but illustrating a different deployment angle of tower arms.
Figure 4:
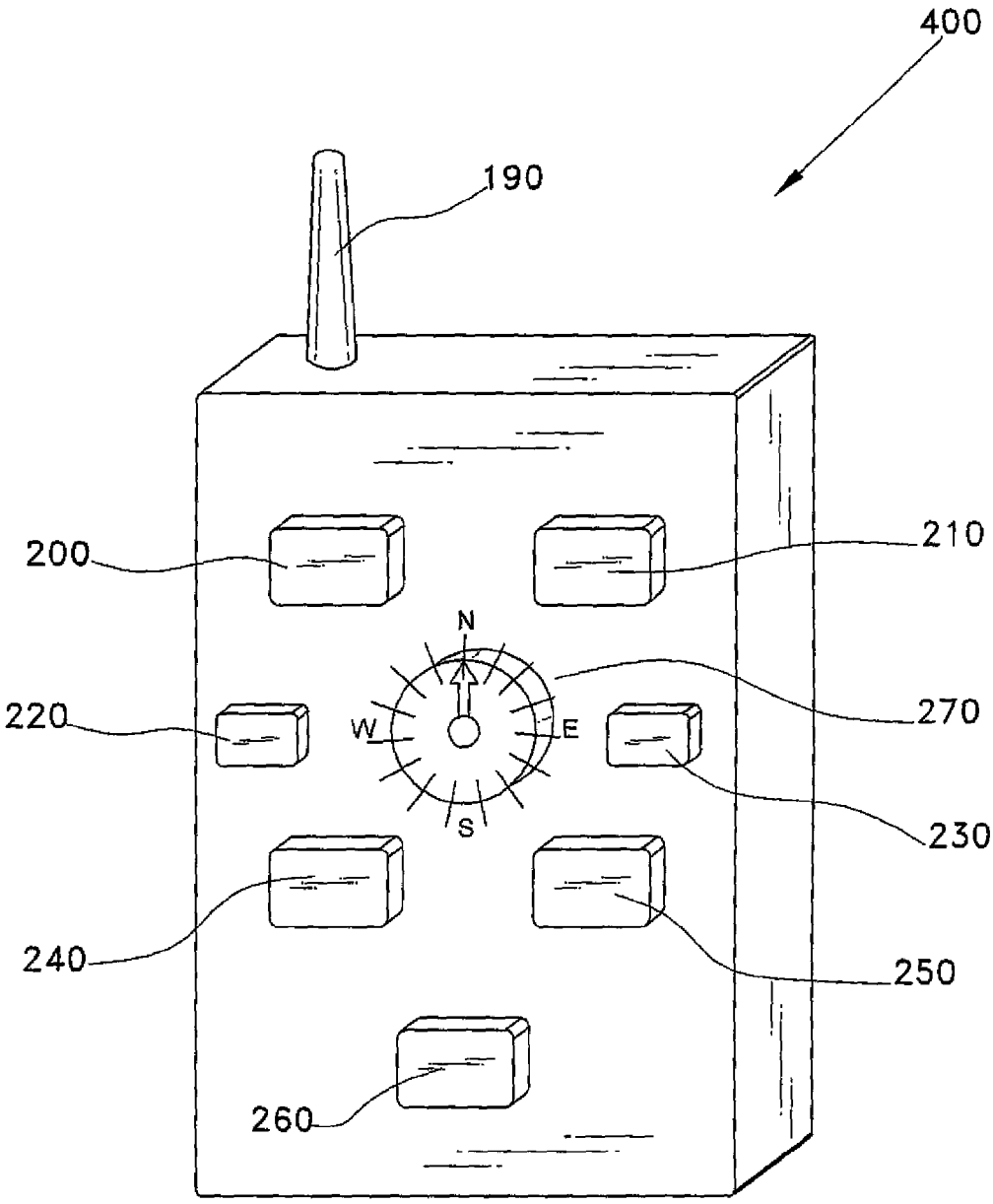
FIG. 4 is a perspective view of a remote control for a roof-mounted remotely controlled firefighting tower according to the present invention.

As shown in FIGS. 1 and 2, the roof-mounted remotely controlled firefighting tower 1000 is disposed on the top of the roof of a building, such as apartment building A, and is controlled (as shown in FIG. 4) by a wireless, remote control device 400. Atop the tower, there is a receiver 10 that receives command signals from the remote control device 400. The firefighting tower 1000 includes components mounted on the roof of the apartment A, including a control set 60, which has electrical and electronic circuits inside and is in operable communication with a motor 50. In addition to operation by remote control, the control set 60 allows the firefighting tower 1000 to be operated manually for maintenance checks and the like.

The motor 50 has an output coupled to an elongate telescoping mast 110 by a gear train, the mast 110 having a telescoping section that includes a rack gear 40. It is assumed that the building A has a shaft extending below roof level from which the mast 110 can be raised and lowered via the motor 50 and gear train. Flexible water lines 90 are attached to the mast 110 and are raised and lowered according to the raising and lowering of the mast 110 by operation of motor 50 and gear train.

Figure 3A:
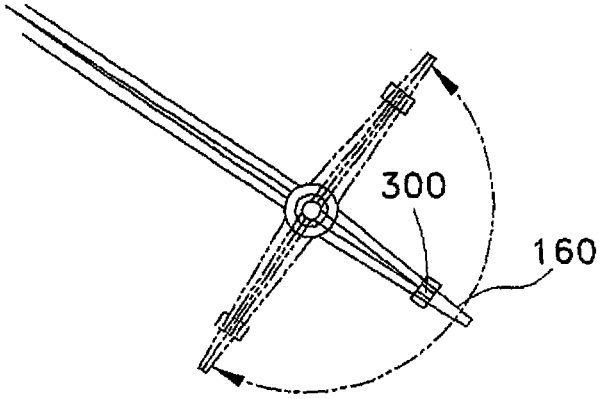
FIG. 3A is a top view illustrating the azimuth pivot freedom of motion of the water nozzles of a roof-mounted remotely controlled firefighting tower according to the present invention.
Figure 3B:
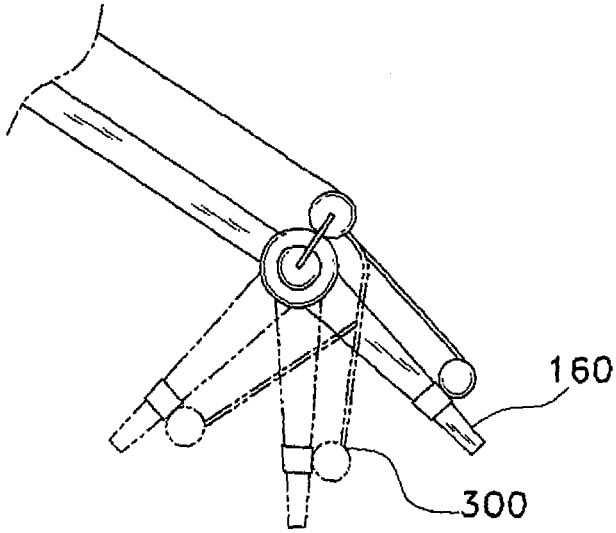
FIG. 3B is a side view illustrating the elevation pivot freedom of motion of the water nozzles of a roof-mounted remotely controlled firefighting tower according to the present invention.

The flexible lines 90 feed a hollow, oblate spheroidal fluid distribution vessel 100 that has an inlet line, and many outlets for feeding arcuate sprinkler distribution pipes 20 configured in an inverted dish arrangement, most of the pipes 20 terminate in a sprinkler head 30 for distribution of water from above the building in a 360° arc, thus inundating the top and the sides of the building A with water. Selectively, a sprinkler distribution pipe 20 may connect to and feed an elongate boom member 130 at an elevational pivot joint 140, wherein the elevation angle of the boom member 130 can be adjusted manually or by remote control. The pipe 20 is connected to a boom tube 120 at the pivot joint 140. The boom tube 120 runs along the length of boom 130, and at the end of the boom 130 the boom tube 120 is connected to a nozzle 160. As shown in FIGS. 2, 3A, and 3B, the nozzle 160 is attached to the boom 130 via a pivot joint 150 that gives the nozzle 160 elevation and azimuth freedom of movement of the nozzle 160. Exemplary tensioning cable 300 provides elevation pointing control of the nozzle 160. As shown in FIG. 1, the cable 300 is attached at attachment point 1600 in order to apply tension to the nozzle 160, thereby allowing the elevation pointing control of the nozzle 160. A similar tensioning cable arrangement terminating at pivot joint 150 allows for azimuth pointing control of the nozzle 160. The nozzle 160 forms a spray of the fluid (water, foam or combination thereof) flowing through the boom tube 120, the spray being directed to portions of the building on fire via remote control commands from the remote control unit 400. The pivotal adjustments of the boom 130 and the nozzle 160 may be effected by cable attachment, such as attachment of cable 300, most clearly shown in FIG. 3B. Cables, such as cable 300, may then be run to a motor in the control set 60 for remote control of cable tensioning to independently effect the pivotal displacement of the boom 130 and nozzle 160 under command from the remote control unit 400.

As shown in FIG. 2, a water and foam tank 70 is disposed on the roof of the building A. A pump 170 provides pressure to draw water from reserve tanks or fire tanks 180 and pressurize the fluid flow through lines 90, which are connected to the distribution vessel 100. The system may also have an auxiliary pump 80.

As shown in FIG. 4, the remote control unit 400 has an antenna 190 to facilitate wireless transmission of commands to the system 1000. Control button 260 provides mode control for the purpose of testing, operations, and turning off the tower 1000. Angular height displacement of the left side boom member 130 is controlled by control key 200. Angular height displacement of the right side boom member 130 is controlled by control key 210. Control key 220 controls the direction of the sprinkler nozzle 160 right-left, i.e., azimuth control. Elevation control of the sprinkler nozzle 160 is accomplished using push button (control key) 230. The left side valve control is accomplished with push button control key 240. The right side valve control is accomplished with push button control key 250. Control key 270 controls movement and direction of the pipes 20.

It is to be understood that the present invention is not limited to the embodiments described above, but encompasses any and all embodiments within the scope of the following claims.

I claim:

1. A roof-mounted remotely controlled firefighting tower, comprising:

a tower assembly adapted for mounting on a roof of a building, the assembly having:

a motor;

a control set having electrical and electronic circuits connected to the motor;

a telescoping mast;

a gear train connecting the motor to the telescoping mast, the gear train including a rack gear attached to a telescoping section of the mast for raising and lowering the mast;

a water tank and foam tank;

a pump providing pressure to draw water and foam from said water and foam tank;

flexible water lines connected to the water and foam tank, the flexible water lines being attached to the mast and routed to a top portion of the mast;

a distribution vessel having an inlet and a plurality of outlets, the vessel being disposed atop the mast, the flexible water lines being connected to the inlet of the distribution vessel, allowing pressurized water and foam to enter the distribution vessel;

a plurality of arcuate sprinkler distribution pipes connected to said distribution vessel outlets, the distribution pipes being configured in an inverted dish extending away from the distribution vessel;

at least one sprinkler head, at least one of said distribution pipes terminating at the at least one sprinkler head, allowing pressurized spray of foam and water to exit over the building;

a left side boom pivotally attached to the inverted dish at an end of a first one of the sprinkler distribution pipes;

a left side boom pipe connected to the end of the first sprinkler distribution pipe, the left side boom pipe extending along the left side boom;

a left side boom nozzle pivotally attached to the left side boom at an end of the left side boom, the left side boom nozzle being connected to an end of the left side boom pipe distal from the attachment of the left side boom to the inverted dish, thereby allowing pressurized water and foam delivery from the left side boom nozzle;

a right side boom pivotally attached to the inverted dish at an end of a second one of the sprinkler distribution pipes;

a right side boom pipe connected to the end of the second sprinkler distribution pipe, the right side boom pipe extending along the right side boom;

a right side boom nozzle pivotally attached to the right side boom at an end of the right side boom, the right side boom nozzle being connected to an end of the right side boom pipe distal from the attachment of the right side boom to the inverted dish, thereby allowing pressurized water and foam delivery from the right side boom nozzle;

boom nozzle cables attached to the boom nozzle pivotal attachments to provide pivotal displacement of the boom nozzles, the boom nozzle cables being routed to a motor portion of the control set, thereby allowing control of the pivotal displacement of the boom nozzles to direct a spray of water and foam against the building's sides; and boom cables attached to the boom pivotal attachments to provide pivotal displacement of the booms, the boom cables being routed to the motor portion of the control set, thereby allowing control of the pivotal displacement of the booms; and a wireless remote control unit operable with the control set, the wireless remote control unit including:

means for remotely controlling pivotal displacement of the booms;

means for remotely controlling pivotal displacement of the boom nozzles;

means for energizing and de-energizing the pump, thereby initiating and halting the pressurized water and foam delivery of the firefighting tower.

2. The roof-mounted remotely controlled firefighting tower according to claim 1, further comprising means for independently pivotally controlling said left side boom and said right side boom.

3. The roof-mounted remotely controlled firefighting tower according to claim 2, further comprising means for independently pivotally controlling said left side nozzle and said right side boom nozzle.

4. The roof-mounted remotely controlled firefighting tower according to claim 3, further comprising means for independently pivotally controlling each said boom nozzle in both azimuth and elevation angular displacement.

* * * * *